US010320090B2

(12) United States Patent
Zou et al.

(10) Patent No.: US 10,320,090 B2
(45) Date of Patent: Jun. 11, 2019

(54) ARRAY ANTENNA

(71) Applicant: Huawei Technologies Co., Ltd., Shenzhen (CN)

(72) Inventors: Keli Zou, Chengdu (CN); Tianxiang Wang, Chengdu (CN); Hua Cai, Chengdu (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 113 days.

(21) Appl. No.: 15/270,668

(22) Filed: Sep. 20, 2016

(65) Prior Publication Data

US 2017/0012363 A1 Jan. 12, 2017

Related U.S. Application Data

(63) Continuation of application No. PCT/CN2014/073831, filed on Mar. 21, 2014.

(51) Int. Cl.

*H01Q 1/38* (2006.01)
*H01Q 21/00* (2006.01)
*H01Q 21/06* (2006.01)

(52) U.S. Cl.

CPC ..... *H01Q 21/061* (2013.01); *H01Q 21/00* (2013.01)

(58) Field of Classification Search

CPC .... H01Q 21/00; H01Q 21/006; H01Q 21/061; H01Q 21/06; H01Q 21/08; H01Q 1/38; H01Q 1/50; H01Q 3/34

See application file for complete search history.

(56) References Cited

U.S. PATENT DOCUMENTS 5,017,931 A * 5/1991 Carlyon ..... H01Q 21/068 343/700 MS
5,872,545 A * 2/1999 Rammos ..... H01Q 21/0075 343/700 MS
6,034,649 A 3/2000 Wilson et al.
6,037,910 A * 3/2000 Solbach ..... H01Q 3/36 343/771

(Continued)

FOREIGN PATENT DOCUMENTS

CN 1254966 A 5/2000
CN 1579035 A 2/2005

(Continued)

OTHER PUBLICATIONS

International Search Report and Written Opinion of the International Search Authority (including English translation) issued in corresponding International Application No. PCT/CN2014/073831, dated Dec. 26, 2014, 23 pages.

*Primary Examiner* — Tho G Phan
(74) *Attorney, Agent, or Firm* — Leydig, Voit & Mayer, Ltd.

(57) ABSTRACT

An array antenna is provided. The array antenna includes at least one pair of interleaved TR antenna arrays in a continuous arraying direction, where the TX arrays and RX arrays of two adjacent TR antenna arrays are interleaved. This can effectively rectify discontinuousness of TX arrays and RX arrays in a discontinuous arraying direction in the prior art, and thereby reduce grating lobes or side lobes caused by discontinuous TX arrays and discontinuous RX arrays in an array antenna, so that performance of the array antenna improves.

7 Claims, 9 Drawing Sheets

(56) References Cited

U.S. PATENT DOCUMENTS

| | | | | |
|---|---|---|---|---|
| 6,175,333 | B1 * | 1/2001 | Smith | H01Q 1/38 343/700 MS |
| 6,496,146 | B1 * | 12/2002 | Chang | H01Q 1/242 343/700 MS |
| 6,509,881 | B2 | 1/2003 | Falk | |
| 6,900,775 | B2 | 5/2005 | Shapira | |
| 7,283,085 | B2 * | 10/2007 | Lee | G01S 13/89 342/372 |
| 7,808,443 | B2 * | 10/2010 | Lindmark | H01Q 1/523 343/844 |
| 2002/0003502 | A1 | 1/2002 | Falk | |
| 2003/0073463 | A1 | 4/2003 | Shapira | |
| 2013/0038506 | A1 | 2/2013 | Johansson et al. | |
| 2013/0162475 | A1 | 6/2013 | Blech et al. | |
| 2014/0044213 | A1 | 2/2014 | Fang et al. | |

FOREIGN PATENT DOCUMENTS

| | | | |
|---|---|---|---|
| CN | 201199544 | Y | 2/2009 |
| CN | 101465473 | A | 6/2009 |
| CN | 102171946 | A | 8/2011 |
| CN | 102521472 | A | 6/2012 |
| CN | 103178356 | A | 6/2013 |
| CN | 203326119 | U | 12/2013 |
| WO | 2013168936 | A1 | 11/2013 |

* cited by examiner

ARRAY ANTENNA

CROSS-REFERENCE TO RELATED APPLICATION

This Application is a continuation of International Application No. PCT/CN2014/073831, filed on Mar. 21, 2014, which is hereby incorporated by reference in its entirety.

TECHNICAL FIELD

The present disclosure relates to the field of communications technologies, and in particular, to an array antenna.

BACKGROUND

Array antennas have a function of beam convergence, and therefore are widely used in the communications field. For example, a phased-radar array antenna includes hundreds or even thousands of elements. For another example, for a multi-sector communications antenna of a base station, each sector implements beam width control in horizontal and pitching directions by means of antenna arraying to achieve signal coverage in a specific area and provide higher gains to obtain a farther communication distance. In addition, an array antenna can also be used to implement estimation of a direction of arrival and the like.

An array antenna is an apparatus with multiple antenna elements included in an antenna. According to requirements, an arrangement manner for elements in an array antenna may be one-dimensional line arrangement, two-dimensional plane arrangement, conformal arrangement on a specific target surface, or three-dimensional arrangement. The specific arrangement may be equally-spaced regular arrangement, or unequally-spaced arrangement may be used when required. Indicators for an array antenna mainly include a gain, a side lobe level (SLL), a beam width, system costs, and the like. Focuses on the indicators vary according to different application scenarios. In applications of the communications field, the system costs and the SLL are most common concerns. A lower SLL helps a system exert better interference resistance performance.

An SLL of an array antenna is mainly determined by an array arrangement manner, and feeding amplitudes and phases of array elements. For a linear array or a matrix array with equally-spaced regular arrangement, an SLL is approximately fixed at about 13.5 dB, specifically determined by factors such as radiation patterns of the elements, a spacing between the elements, and mutual coupling between the elements. In addition, the spacing between the elements is strictly limited within one wavelength to avoid grating lobes. Excited amplitude weighting for the array elements can decrease the SLL but reduce aperture efficiency as well. This does not decrease the system costs but increases difficulties in implementing a system design, thereby applicable to a relatively narrow scope.

In the field of millimeter band communications, especially the field of high-frequency millimeter band communications, for example, when a working wavelength of a 60 GHz millimeter band is only 5 mm, a size of an element in a corresponding array antenna is usually smaller than half a wavelength, that is 2.5 mm. In this case, a transmit-receive component of a system usually integrates receive and transmit antenna arrays. However, for a system working in a frequency division duplexing (FDD) mode, since a radio frequency device such as a duplexer is difficult to be integrated, a transmit-receive antenna array is usually integrated in a form in which a receive antenna array and a transmit antenna array are separated from each other. In appearance, this is manifested by a separate receive antenna array (RX array for short) and a separate transmit antenna array (TX array for short), and the TX array and the RX array together form a TR antenna array. FIG. 1 is a schematic diagram of a TR antenna array, where a TX array or an RX array may be arranged as an array antenna in any form. The array antenna is generally arrayed by using the TR antenna array shown in FIG. 1, which is also known as secondary arraying.

To meet requirements for long distance communications, multiple TR antenna arrays may be required for secondary arraying. Refer to FIG. 2, which is a schematic diagram of multiple TR antenna arrays arranged as an array antenna. A direction along which one TX array and another TX array are not continuous and one RX array and another RX array are not continuous is referred to as a discontinuous arraying direction, and a direction along which multiple TX arrays are continuous and multiple RX arrays are continuous is referred to as a continuous arraying direction. However, since a TX array and an RX array usually have a size greater than one working wavelength and are physically separated from each other, using the typical regular arrangement method of a TR antenna array may introduce a problem of grating lobes or high side lobes. As a result, a system does not have a strong interference resistance capability or even cannot work normally.

SUMMARY

Embodiments of the present disclosure provide an array antenna to resolve a problem of grating lobes or high side lobes caused by arraying of multiple TR antenna arrays in the prior art.

A first aspect of the present disclosure provides an array antenna, where the array antenna includes at least one pair of interleaved transmit-receive TR antenna arrays in a continuous arraying direction, where the one pair of interleaved TR antenna arrays means that transmit antenna TX arrays and receive antenna RX arrays of two adjacent TR antenna arrays are interleaved.

A second aspect of the present disclosure provides an array antenna, where in a discontinuous arraying direction of the array antenna, a quantity of TR antenna arrays changes in an ascending order from an outermost column of transmit-receive TR antenna arrays to a middle column of TR antenna arrays, so that the array antenna takes on tapered distribution.

A third aspect of the present disclosure provides an array antenna. The array antenna includes antennas arranged in a tapered distribution including a first direction and a second direction. A quantity of transmit-receive (TR) antenna arrays in the first direction changes in an ascending order from an outermost column of transmit-receive (TR) antenna arrays to a middle column of TR antenna arrays.

It should be understood that both the foregoing general description and the following detailed description are exemplary and explanatory only and are not restrictive of the disclosure.

DESCRIPTION OF EMBODIMENTS

Figure 1:
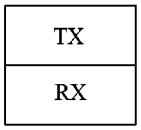
FIG. 1 Prior Art
FIG. 1 is a schematic diagram of a TR antenna array in the prior art.
Figure 2:
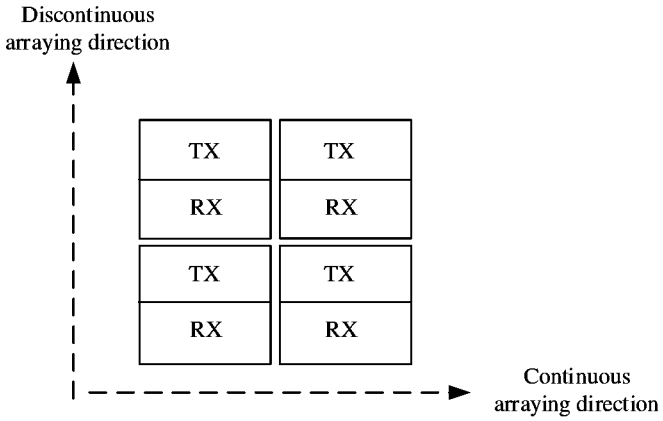
FIG. 2 Prior Art
FIG. 2 is a schematic diagram of multiple TR antenna arrays arranged as an array antenna in the prior art.

Embodiments of the present disclosure provide an array antenna to resolve a problem of grating lobes or high side lobes caused by arraying of multiple TR antenna arrays in the prior art.

The terminology used in the present disclosure is for the purpose of describing exemplary embodiments only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," etc. may include used herein to describe various information, the information should not be limited by these terms. These terms are only used to distinguish one category of information from another. For example, without departing from the scope of the present disclosure, first information may include termed as second information; and similarly, second information may also be termed as first information. As used herein, the term "if" may include understood to mean "when" or "upon" or "in response to" depending on the context.

Reference throughout this specification to "one embodiment," "an embodiment," "exemplary embodiment," or the like in the singular or plural means that one or more particular features, structures, or characteristics described in connection with an embodiment is included in at least one embodiment of the present disclosure. Thus, the appearances of the phrases "in one embodiment" or "in an embodiment," "in an exemplary embodiment," or the like in the singular or plural in various places throughout this specification are not necessarily all referring to the same embodiment. Furthermore, the particular features, structures, or characteristics in one or more embodiments may include combined in any suitable manner.

With reference to the first possible implementation manner of the first aspect, in a second possible implementation manner of the first aspect, if the array antenna includes at least two rows of interleaved TR antenna arrays in the continuous arraying direction, arrangement manners for the at least two rows of interleaved TR antenna arrays are identical or different.

With reference to the first aspect, the first possible implementation manner of the first aspect, or the second possible implementation manner of the first aspect, in a third possible implementation manner of the first aspect, TR antenna arrays of the array antenna are arranged in an even arrangement manner.

With reference to the first aspect, the first possible implementation manner of the first aspect, or the second possible implementation manner of the first aspect, in a fourth possible implementation manner of the first aspect, in a discontinuous arraying direction of the array antenna, a quantity of TR antenna arrays changes in an ascending order from an outermost column of TR antenna arrays to a middle column of TR antenna arrays, so that the array antenna takes on tapered distribution.

With reference to the fourth possible implementation manner of the first aspect, in a fifth possible implementation manner of the first aspect, the array antenna includes at least one row of TR antenna arrays irregularly aligned with an adjacent row of TR antenna arrays.

In a first possible implementation manner of the second aspect, the array antenna includes at least one row of TR antenna arrays irregularly aligned with an adjacent row of TR antenna arrays.

In a second possible implementation manner of the second aspect, the array antenna includes, in the discontinuous arraying direction, at least one column of TR antenna arrays translated by one TX array or one TR antenna array.

With reference to the second possible implementation manner of the second aspect, in a third possible implementation manner of the second aspect, the array antenna includes at least one TR antenna array rotated by 180 degrees or at least one TR antenna array with positions of TX arrays and RX arrays interchanged.

With reference to the second aspect or the first possible implementation manner of the second aspect, in a fourth possible implementation manner of the second aspect, the array antenna includes at least one pair of interleaved TR antenna arrays in a continuous arraying direction, where the one pair of interleaved TR antenna arrays means that TX arrays and RX arrays of two adjacent TR antenna arrays are interleaved.

With reference to the fourth possible implementation manner of the second aspect, in a fifth possible implementation manner of the second aspect, the array antenna includes at least one row of interleaved TR antenna arrays in the continuous arraying direction, where the one row of interleaved TR antenna arrays means that one row of TR antenna arrays includes at least one pair of interleaved TR antenna arrays.

With reference to the fifth possible implementation manner of the second aspect, in a six possible implementation manner of the second aspect, if the array antenna includes at least two rows of interleaved TR antenna arrays in the continuous arraying direction, arrangement manners for the at least two rows of interleaved TR antenna arrays are identical or different.

The foregoing technical solutions that the embodiments of the present disclosure have the following advantages. An array antenna includes at least one pair of interleaved TR antenna arrays in a continuous arraying direction, and the one pair of interleaved TR antenna arrays means that TX arrays and RX arrays of two adjacent TR antenna arrays are interleaved. This can effectively rectify discontinuousness of TX arrays and RX arrays in a discontinuous arraying direction in the prior art, and thereby reduce grating lobes or side lobes caused by discontinuous TX arrays and discontinuous RX arrays in an array antenna, so that performance of the array antenna improves.

Figure 3A:
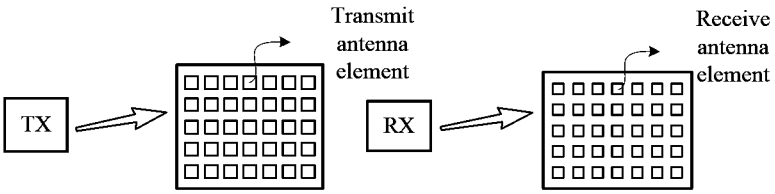
FIG. 3*a* is a schematic diagram of arrangement manners for antenna elements of a TX array and those of an RX array according to an embodiment of the present disclosure.
Figure 3B:
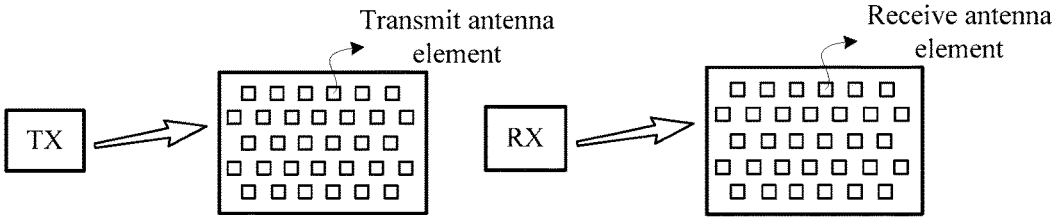
FIG. 3*b* is another schematic diagram of arrangement manners for antenna elements of a TX array and those of an RX array according to an embodiment of the present disclosure.
Figure 3C:
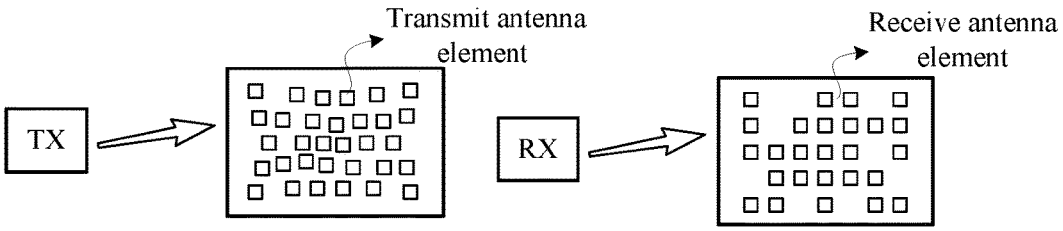
FIG. 3*c* is another schematic diagram of arrangement manners for antenna elements of a TX array and those of an RX array according to an embodiment of the present disclosure.

It should be noted that the array antenna described in the embodiments of the present disclosure is a result of secondary arraying based on a TR antenna array shown in FIG. 1, and a TX array or an RX array may be arranged in any form. Refer to FIG. 3*a* to FIG. 3*c*, all of which are optional arrangement manners for antenna elements of a TX array and those of an RX array in a TR antenna array in the embodiments of the present disclosure. In addition, the antenna elements of the TX array may be referred to as transmit antenna elements, and the antenna elements of the RX array may be referred to as receive antenna elements. In FIG. 3*a*, the antenna elements of the TX array and those of the RX array are both arranged in an arrangement manner of a standard rectangle array. In FIG. 3*b*, the antenna elements of the TX array and those of the RX array are both arranged in an arrangement manner of a triangle array. In FIG. 3*c*, the antenna elements of the TX array are arrayed in a sparse manner, and the antenna elements of the RX array are arranged in an arrangement manner of a thinned array. In addition, FIG. 3*a* to FIG. 3*c* make illustration by using an example in which an antenna element of the TX array and that of the RX array are both shaped into a rectangle. In actual application, antenna elements of a TX array and those of an RX array may be shaped into circles, irregular shapes, or other shapes, and an arrangement manner for the antenna elements of the TX array and an arrangement manner for the antenna elements of the RX array may be identical or different. Therefore, arrangement manners for antenna elements of a TX array and those of an RX array in a TR antenna array and a pattern into which an antenna element is shaped may be determined according to specific requirements, and are not limited herein.

Embodiment 1

Figure 4:
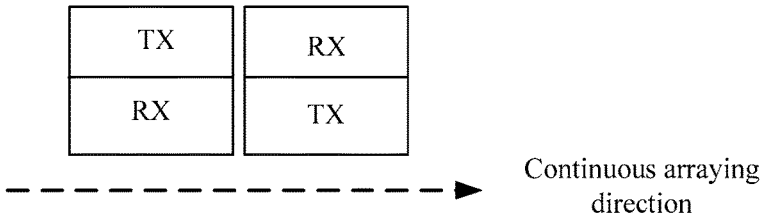
FIG. 4 is a schematic diagram of one pair of interleaved TR antenna arrays in a continuous arraying direction according to an embodiment of the present disclosure.
Figure 5:
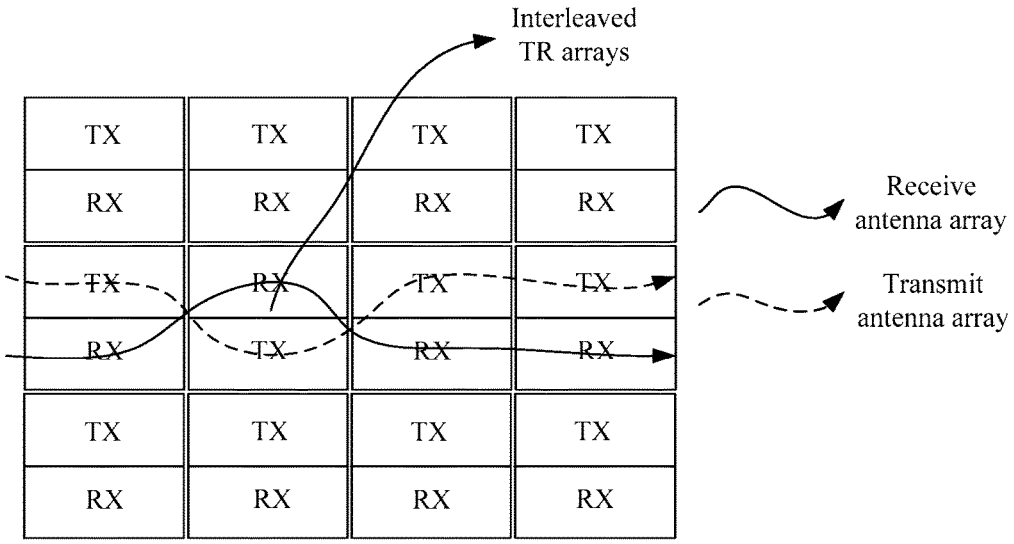
FIG. 5 is a schematic diagram of an array antenna according to an embodiment of the present disclosure.

In this embodiment of the present disclosure, to resolve a problem of grating lobes or high side lobes caused by discontinuous arrangement of TX arrays and RX arrays in an arraying direction of an array antenna, an array antenna may be arranged in the following manner. Specifically, the array antenna includes at least one pair of interleaved TR antenna arrays in a continuous arraying direction. The one pair of interleaved TR antenna arrays means that TX arrays and RX arrays of two adjacent TR antenna arrays are interleaved. Refer to FIG. 4, which is a schematic diagram of one pair of interleaved TR antenna arrays in the continuous arraying direction in this embodiment of the present disclosure. Refer to FIG. 5, which is a schematic diagram of the array antenna. The array antenna includes interleaved TR antenna arrays in a second row in the continuous arraying direction.

In this embodiment of the present disclosure, the array antenna includes at least one pair of interleaved TR antenna arrays in the continuous arraying direction, which can rectify discontinuousness of one pair of TR antenna arrays in a discontinuous arraying direction and thereby reduce grating lobes or side lobes introduced by widely-spaced discontinuous arrangement of one TX array and another TX array and one RX array and another RX array, so that performance of the array antenna can be effectively improved.

Figure 6:
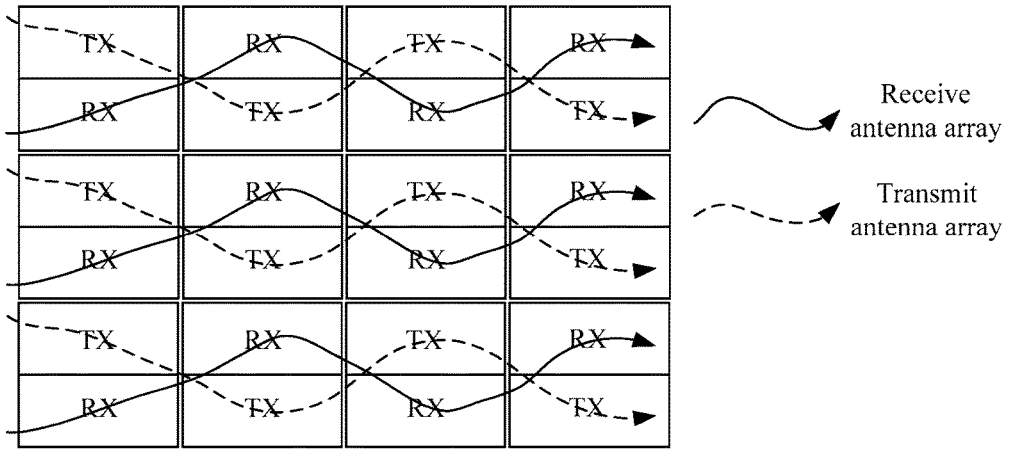
FIG. 6 is another schematic diagram of an array antenna according to an embodiment of the present disclosure.
Figure 7:
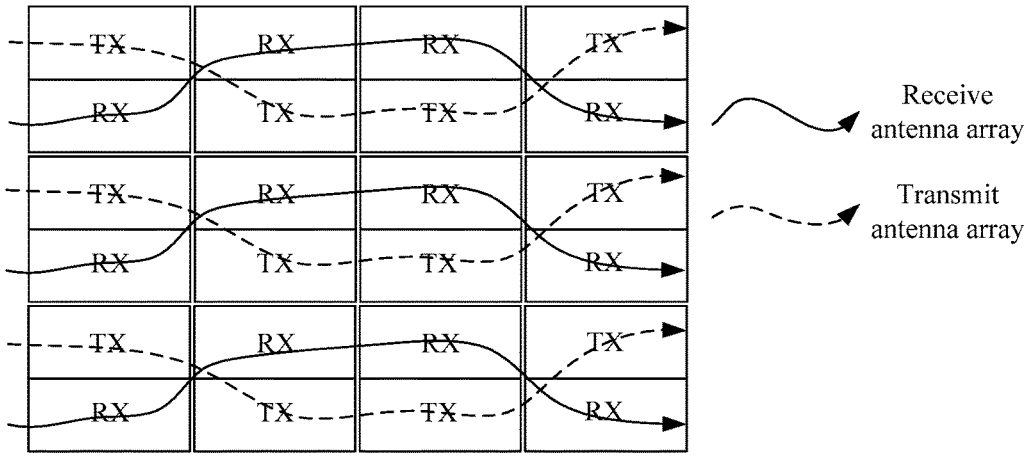
FIG. 7 is another schematic diagram of an array antenna according to an embodiment of the present disclosure.

For example, on the basis that the array antenna includes at least one pair of interleaved TR antenna arrays, the array antenna may be further arranged in the following manner: The array antenna includes at least one row of interleaved TR antenna arrays in the continuous arraying direction. The one row of interleaved TR antenna arrays may mean that one row of TR antenna arrays includes at least one pair of interleaved TR antenna arrays. Refer to FIG. 6, which is another schematic diagram of the array antenna, where all three rows of TR antenna arrays of the array antenna are interleaved in the continuous arraying direction. Refer to FIG. 7, which is another schematic diagram of the array antenna, where among three rows of TR antenna arrays of the array antenna in the continuous arraying direction, in two middle columns of TR antenna arrays, adjacent TR antenna arrays located in a same row are not interleaved.

Figure 8:
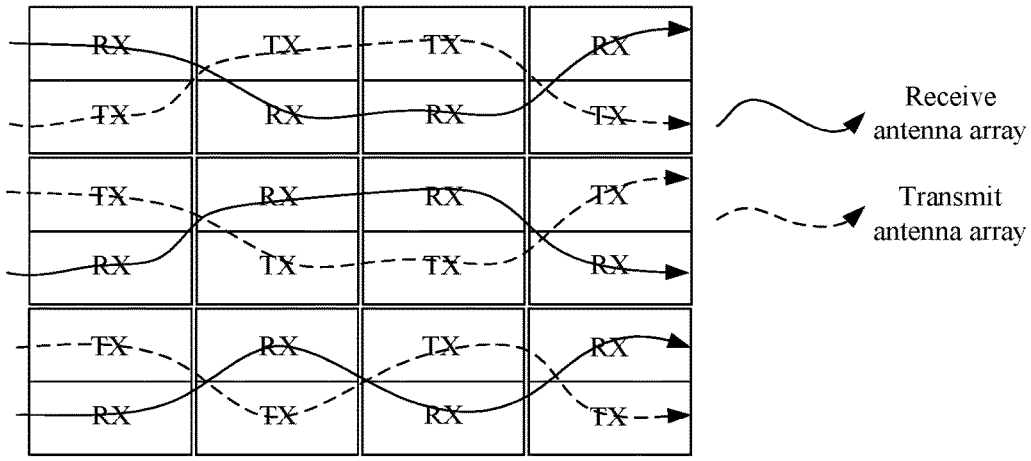
FIG. 8 is another schematic diagram of an array antenna according to an embodiment of the present disclosure.

For example, in this embodiment of the present disclosure, if the array antenna includes at least two rows of interleaved TR antenna arrays in the continuous arraying direction, arrangement manners for the at least two rows of interleaved TR antenna arrays may be identical or different. Refer to FIG. 6, which is another schematic diagram of the array antenna, where all rows of interleaved TR antenna arrays in the array antenna have an identical arrangement manner. Refer to FIG. 8, which is another schematic diagram of the array antenna, where arrangement manners for three rows of interleaved TR antenna arrays in the array antenna are all different.

Figure 9:
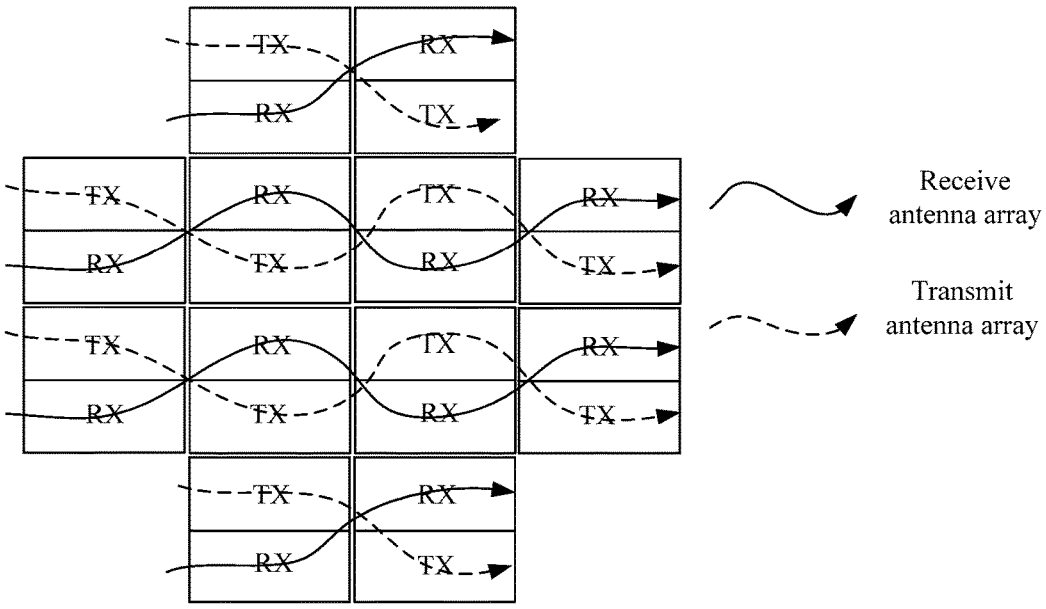
FIG. 9 is another schematic diagram of an array antenna according to an embodiment of the present disclosure.

In this embodiment of the present disclosure, the array antennas in FIG. 4 to FIG. 8 are all described by using evenly-arranged array antennas as examples. Arrangement of an evenly-arranged array antenna is in an M*N format, and both M and N are greater than 2. For example, to better reduce grating lobes or side lobes, in a discontinuous arraying direction of the array antenna, a quantity of TR antenna arrays changes in an ascending order from an outermost column of TR antenna arrays to a middle column of TR antenna arrays, so that the array antenna takes on tapered distribution. Refer to FIG. 9, which is another schematic diagram of the array antenna. The array antenna takes on tapered distribution and includes interleaved TR antenna arrays. It should be noted that all arrangement manners in which an array antenna taking on tapered distribution includes at least one pair of interleaved TR antenna arrays are technical solutions under protection of the present disclosure.

Figure 10:
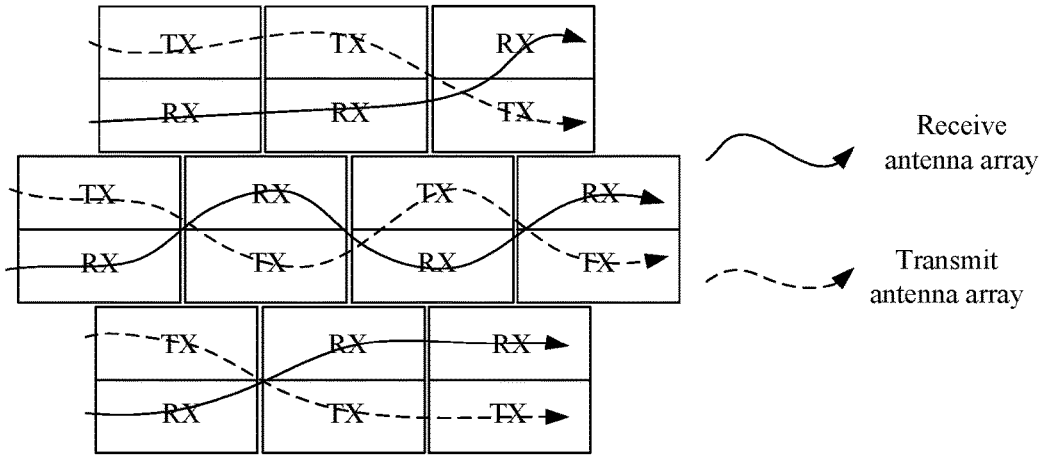
FIG. 10 is another schematic diagram of an array antenna according to an embodiment of the present disclosure.

For example, based on the array antenna that includes at least one pair of interleaved TR antenna arrays and takes on tapered distribution, to further reduce grating lobes or side lobes, the array antenna in this embodiment of the present disclosure may further include at least one row of TR antenna arrays irregularly aligned with an adjacent row of TR antenna arrays. Refer to FIG. 10, which is anther schematic diagram of the array antenna. The array antenna takes on tapered distribution and includes interleaved TR antenna arrays. In addition, a first row and a third row of TR antenna arrays are not aligned with a second row of TR antenna arrays.

In this embodiment of the present disclosure, an array antenna includes at least one pair of interleaved TR antenna arrays, which can effectively rectify discontinuousness of the array antenna in a discontinuous arraying direction and thereby reduce grating lobes or side lobes. Further, the array antenna including at least one pair of interleaved TR antenna arrays takes on tapered distribution, which can further reduce grating lobes or side lobes and effectively improve performance of the array antenna.

It should be noted that, in an array antenna theory, a radiation pattern of an array antenna is formed by radiation patterns of array elements multiplying array factors, and the array factors are determined by geometric arrangement of the array elements. Corresponding to the present disclosure, an array element is a TX array or an RX array, and an array factor is determined by a geometric arrangement manner of a TR antenna array. In addition, a wider spacing between array elements leads to higher side lobes of a corresponding array factor, and the side lobes become even higher after the array factor multiplies radiation patterns of the array elements. However, using an arrangement manner in which TX arrays and RX arrays are interleaved reduces a spacing between one TX array and another TX array and a spacing between one RX array and another RX array, and therefore reduces side lobes of the array factor. In this way, the array radiation pattern obtained by multiplying the array factor and the radiation patterns of the array elements has lower grating lobes or side lobes, achieving a purpose of reducing grating lobes or side lobes. Therefore, the technical solution in this embodiment of the present disclosure can effectively reduce grating lobes or side lobes and improve performance of the array antenna. In addition, as side lobes of an array factor in tapered distribution are lower, grating lobes or side lobes can also be reduced.

Embodiment 2

Figure 11:
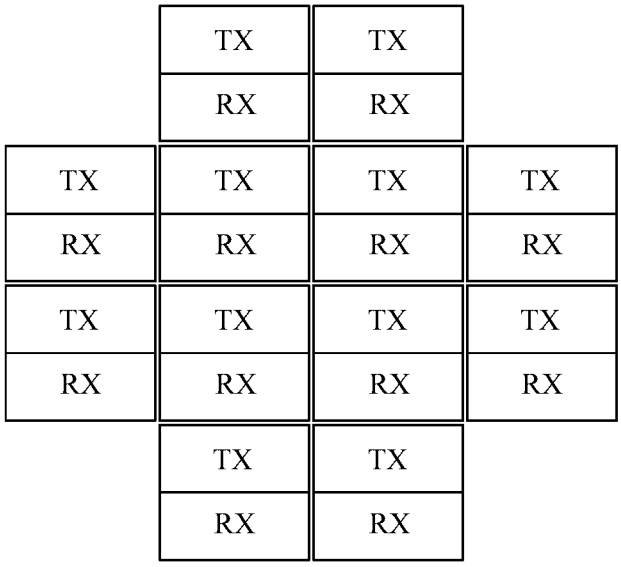
FIG. 11 is another schematic diagram of an array antenna according to an embodiment of the present disclosure.
Figure 12:
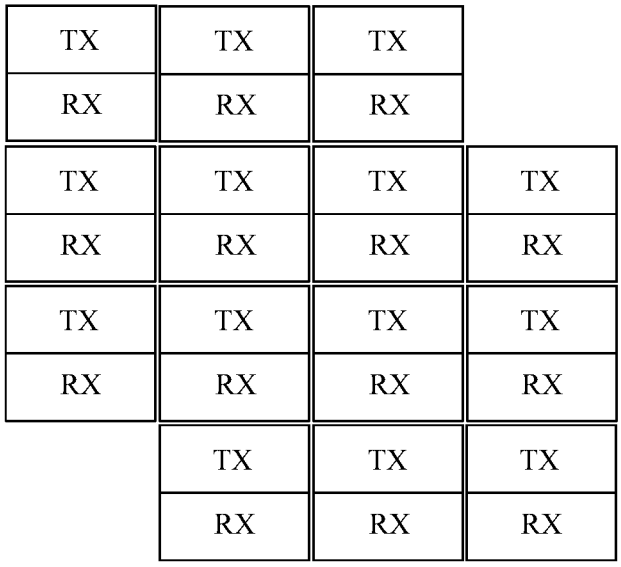
FIG. 12 is another schematic diagram of an array antenna according to an embodiment of the present disclosure.

In this embodiment of the present disclosure, to resolve a problem of grating lobes or high side lobes caused by discontinuous arrangement of TX arrays and RX arrays in an arraying direction of an array antenna, an array antenna may be arranged in the following manner: In a discontinuous arraying direction of the array antenna, a quantity of TR antenna arrays changes in an ascending order from an outermost column of TR antenna arrays to a middle column of TR antenna arrays, so that the array antenna takes on tapered distribution. Refer to FIG. 11, which is another schematic diagram of the array antenna in this embodiment of the present disclosure. A quantity of TR antenna arrays at either end of the array antenna is smaller than a quantity of TR antenna arrays in the middle, so that tapered distribution is formed. Refer to FIG. 12, which is another schematic diagram of the array antenna. A quantity of TR antenna arrays on each of four peripheral sides of the array antenna is smaller than a quantity of TR antenna arrays in a middle row, so that tapered distribution is formed.

Figure 13:
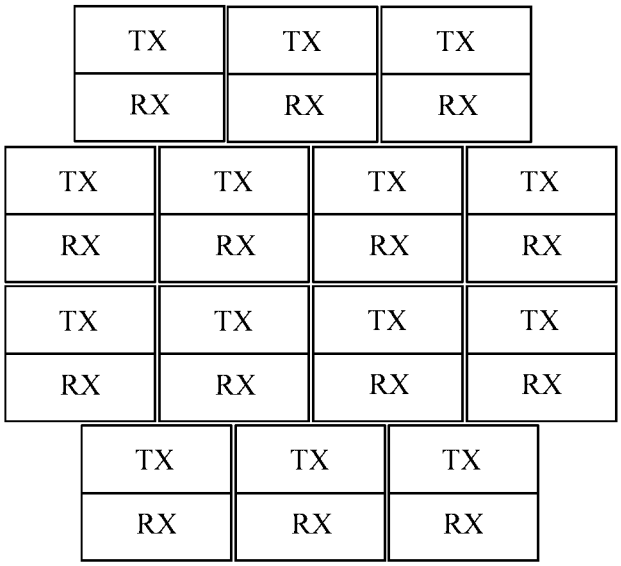
FIG. 13 is another schematic diagram of an array antenna according to an embodiment of the present disclosure.

In this embodiment of the present disclosure, based on the tapered distribution of antenna arrays, there are the following extended arrangement manners:

1. The array antenna may further include at least one row of TR antenna arrays irregularly aligned with an adjacent row of TR antenna arrays. Refer to FIG. 13, which is another schematic diagram of the array antenna. The array antenna takes on tapered distribution, and in a continuous arraying direction, a first row and a second row are irregularly aligned, a fourth row and a third row are irregularly aligned, and the second row and the third row are regularly aligned. An arrangement manner of irregular alignment between TX arrays and RX arrays during arraying can also effectively rectify discontinuousness of the array antenna in the discontinuous arraying direction, reduce grating lobes or side lobes, and improve performance of the array antenna.

It should be noted that, on the basis that the array antenna taking on tapered distribution includes at least one row of TR antenna arrays irregularly aligned with an adjacent row of TR antenna arrays, the array antenna further includes at least one pair of interleaved TR antenna arrays. The one pair of interleaved TR antenna arrays means that TX arrays and RX arrays of two adjacent TR antenna arrays are interleaved. Further, the array antenna may include at least one row of interleaved TR antenna arrays in the continuous arraying direction. The one row of interleaved TR antenna arrays means that one row of TR antenna arrays includes at least one pair of interleaved TR antenna arrays. Refer to FIG. 10, which is a schematic diagram of the array antenna in this embodiment of the present disclosure. The array antenna takes on tapered distribution. A first row to a third row all include interleaved TR antenna arrays, and in the continuous arraying direction, TR antenna arrays of the first row and the second row are irregularly aligned, and TR antenna arrays of the second row and the third row are irregularly aligned.

Figure 14:
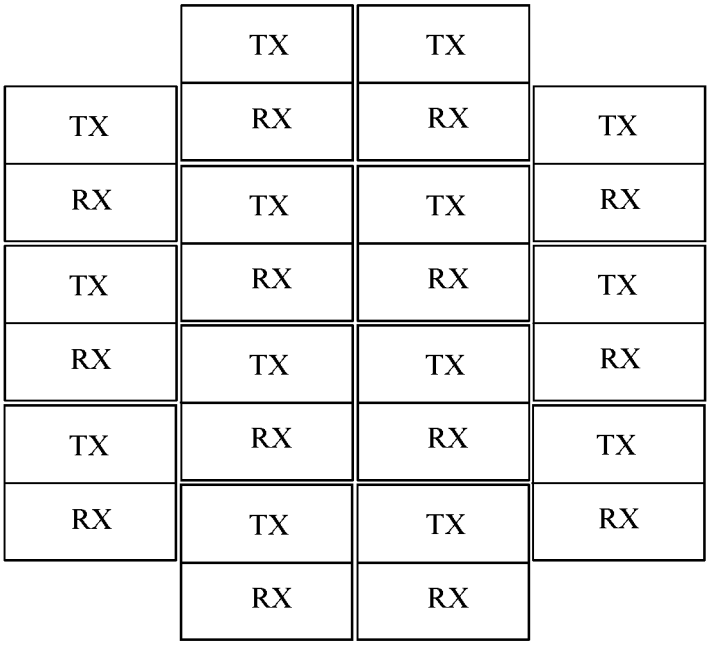
FIG. 14 is another schematic diagram of an array antenna according to an embodiment of the present disclosure.

2. The array antenna includes, in the discontinuous arraying direction, at least one column of TR antenna arrays translated by one TX array or one TR antenna array, so that there are continuous TX arrays and continuous RX arrays in the discontinuous arraying direction, thereby reducing grating lobes or side lobes and improving performance of the array antenna. Refer to FIG. 14, which is another schematic diagram of the array antenna. Two middle columns of the array antenna are both translated by one TX array or one RX array.

Figure 15:
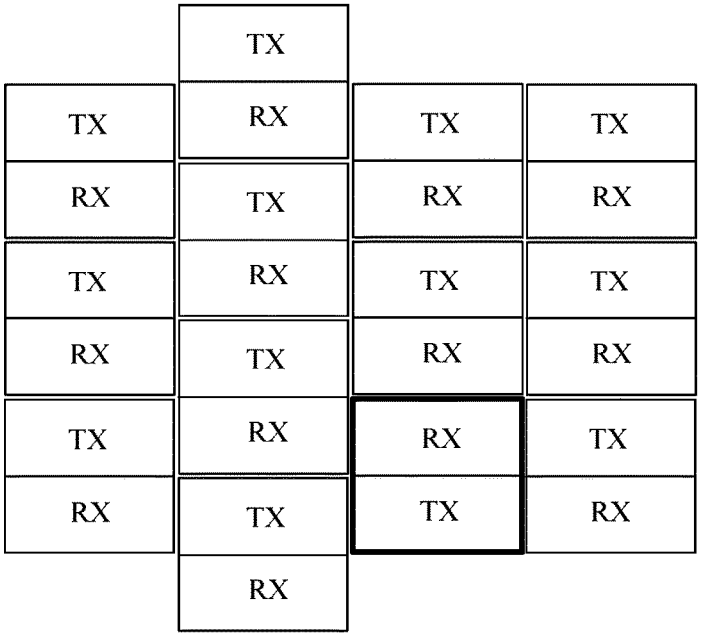
FIG. 15 is another schematic diagram of an array antenna according to an embodiment of the present disclosure.

For example, to further reduce grating lobes or side lobes, the array antenna includes at least one TR antenna array rotated by 180 degrees or includes at least one TR antenna array with positions of TX arrays and RX arrays interchanged. In addition, the at least one TR antenna array rotated by 180 degrees or the at least one TR antenna array with positions of TX arrays and RX arrays interchanged may be not among the foregoing TR antenna arrays translated by one TX array or one RX array, or may be among the foregoing TR antenna arrays translated by one TX array or one RX array. Refer to FIG. 15, which is another schematic diagram of the array antenna. A second column of the antenna array is translated by one TX array or one RX array, and a TR antenna array in bold is a TR antenna array rotated by 180 degrees or a TR antenna array with positions of TX arrays and RX arrays interchanged.

3. The array antenna includes at least one pair of interleaved TR antenna arrays in a continuous arraying direction. The one pair of interleaved TR antenna arrays means that TX arrays and RX arrays of two adjacent TR antenna arrays are interleaved. Further, the array antenna may include at least one row of interleaved TR antenna arrays in the continuous arraying direction. The one row of interleaved TR antenna arrays means that one row of TR antenna arrays includes at least one pair of interleaved TR antenna arrays. Refer to FIG. 8, which is another schematic diagram of the array antenna. The array antenna takes on tapered distribution and includes interleaved TR antenna arrays. Refer to FIG. 10, which is another schematic diagram of the array antenna. The array antenna takes on tapered distribution and includes interleaved TR antenna arrays.

Figure 16:
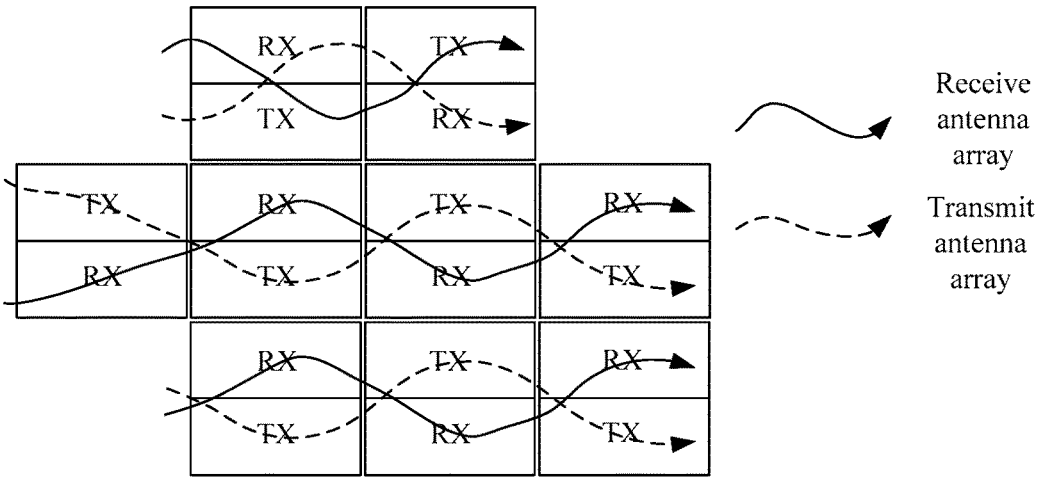
FIG. 16 is another schematic diagram of an array antenna according to an embodiment of the present disclosure.
Figure 17:
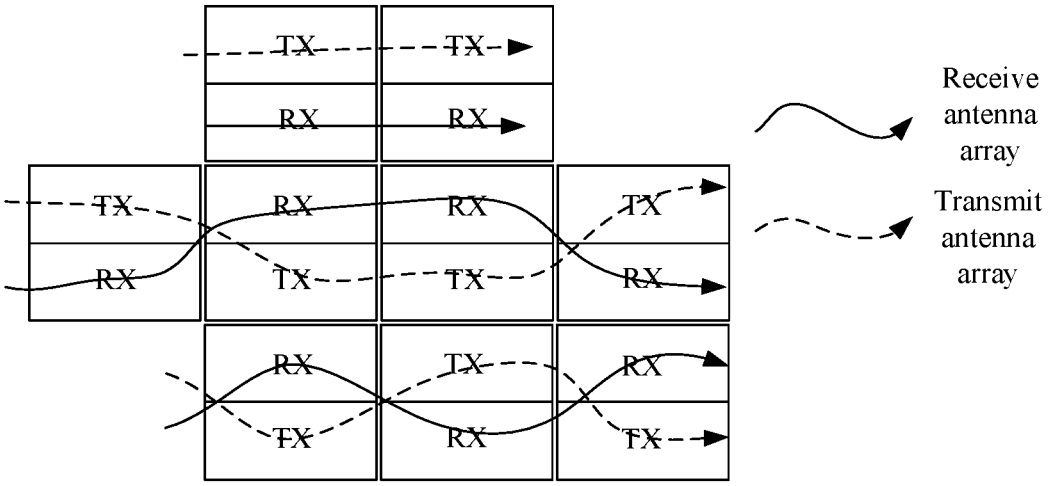
FIG. 17 is another schematic diagram of an array antenna according to an embodiment of the present disclosure.

For example, in this embodiment of the present disclosure, if the array antenna includes at least two rows of interleaved TR antenna arrays in the continuous arraying direction, arrangement manners for the at least two rows of interleaved TR antenna arrays are identical or different. Refer to FIG. 16, which is another schematic diagram of the array antenna. The array antenna takes on tapered distribution, and in the continuous arraying direction of the array antenna, arrangement manners for three rows of interleaved TR antenna arrays are identical. Refer to FIG. 17, which is another schematic diagram of the array antenna. The array antenna takes on tapered distribution, and in the continuous arraying direction of the array antenna, arrangement manners for two rows of interleaved TR antenna arrays are different.

In this embodiment of the present disclosure, arranging the array antenna in a tapered distribution manner can effectively reduce grating lobes or side lobes and improve performance of the array antenna. In addition, for the array antenna in tapered distribution, interleaved TR antenna arrays and/or irregularly aligned TR antenna arrays and like manners can also be used to reduce the grating lobes or side lobes.

A person of ordinary skill in the art may understand that all or some of the steps of the methods in the embodiments may be implemented by a program instructing relevant hardware. The program may be stored in a computer readable storage medium. The storage medium may include: a read-only memory, a magnetic disk, or an optical disc.

The foregoing describes in detail an array antenna provided in the present disclosure. With respect to the implementation manners and the application scope, modifications may be made by a person of ordinary skill in the art according to the idea of the embodiments of the present disclosure. Therefore, this specification shall not be construed as a limitation on the present disclosure.

What is claimed is:

1. An array antenna, wherein the array antenna comprises at least one pair of interleaved transmit-receive (TR) antenna arrays in a continuous arraying direction, wherein the at least one pair of interleaved TR antenna arrays includes two adjacent TR antenna arrays comprising transmit antenna (TX) arrays and receive antenna (RX) arrays that are interleavingly disposed;

wherein the array antenna comprises at least one row of interleaved TR antenna arrays in the continuous arraying direction, wherein the at least one row of interleaved TR antenna arrays comprises at least one pair of interleaved TR antenna arrays.

2. The array antenna according to claim 1, wherein when the array antenna comprises at least two rows of interleaved TR antenna arrays in the continuous arraying direction.

3. The array antenna according to claim 2, wherein arrangement manners for the at least two rows of interleaved TR antenna arrays are identical.

4. The array antenna according to claim 2, wherein arrangement manners for the at least two rows of interleaved TR antenna arrays are different.

5. The array antenna according to claim 1, wherein TR antenna arrays of the array antenna are arranged in an even arrangement manner.

6. The array antenna according to claim 1, wherein in a discontinuous arraying direction of the array antenna, a quantity of TR antenna arrays changes in an ascending order from an outermost column of TR antenna arrays to a middle column of TR antenna arrays, so that the array antenna takes on tapered distribution.

7. The array antenna according to claim 6, wherein the array antenna comprises at least one row of TR antenna arrays irregularly aligned with an adjacent row of TR antenna arrays.

* * * * *